US007268790B1

(12) United States Patent
Small et al.

(10) Patent No.: US 7,268,790 B1
(45) Date of Patent: Sep. 11, 2007

(54) DISPLAY SYSTEM WITH FRAMESTORE AND STOCHASTIC DITHERING

(75) Inventors: Jeffrey A. Small, Rochester, NY (US); Christopher A. Ludden, Pittsford, NY (US)

(73) Assignee: National Semiconductor Corporation, Santa Clara, CA (US)

( * ) Notice: Subject to any disclaimer, the term of this patent is extended or adjusted under 35 U.S.C. 154(b) by 643 days.

(21) Appl. No.: 10/230,975

(22) Filed: Aug. 29, 2002

(51) Int. Cl.
*G09G 5/02* (2006.01)

(52) U.S. Cl. ..... 345/596; 345/597; 345/599; 345/611; 345/694; 382/261; 382/263; 382/264; 382/265; 382/274; 358/3.14; 358/3.19

(58) Field of Classification Search ..... 345/596, 345/597, 598, 599, 694
See application file for complete search history.

(56) References Cited

U.S. PATENT DOCUMENTS 5,714,974 A * 2/1998 Liu ..... 345/694
5,905,504 A * 5/1999 Barkans et al. ..... 345/597
6,008,794 A * 12/1999 Ishii ..... 345/598
6,064,359 A * 5/2000 Lin et al. ..... 345/89
6,191,793 B1 * 2/2001 Piazza et al. ..... 345/582
6,330,368 B1 * 12/2001 Ulichney ..... 382/251
6,433,891 B1 * 8/2002 Yu et al. ..... 358/1.9
7,187,474 B1 * 3/2007 Chen et al. ..... 358/3.2

OTHER PUBLICATIONS

B. E. Bayer, *An Optimum Method for Two-Level Rendition of Continuous-Tone Pictures;* 1973; pp. 26-11-26-15.
PixTech The Field Emission Display Company; *Producing Gray Scale On A Monochrome FED Using Frame Rate Control*; Aug. 7, 1998; pp. 1-2; Application Note G002.
Robert Ulichney; *Digital Halftoning*; Published Apr. 1987; Chapter 8 Dithering with Blue Noise; pp. 233-238.

* cited by examiner

*Primary Examiner*—Kee M. Tung
*Assistant Examiner*—Antonio A Caschera
(74) *Attorney, Agent, or Firm*—Merchant & Gould P.C.

(57) ABSTRACT

A display system provides temporal stochastic dithering to image data for storage in a frame buffer for display. Stochastic dithering is used to reduce the size of the frame buffer and the complexity of the drive circuitry that is used to display an image in accordance with the image data. The bit depth of the frame buffer is reduced by spatially dithering image data for the image data before the image data is written into the frame buffer. Additionally, the displayed image is temporally dithered by using a different dither pattern for successive frames. Uncorrelated stochastic dither patterns are used to minimize detection of the dither patterns within the displayed image.

24 Claims, 3 Drawing Sheets

DISPLAY SYSTEM WITH FRAMESTORE AND STOCHASTIC DITHERING

FIELD OF THE INVENTION

The present invention relates generally to video display systems, and more particularly to temporally dithering image data for video display systems.

BACKGROUND OF THE INVENTION

The cost of a conventional display system may be lowered by reducing the number of tone scale levels of pixels within image data. An exemplary imaging system includes image data that is to be displayed may contain 24 bits of information, with eight bits each being reserved for red, green, and blue tone values. Many conventional display systems are able to display the image data at the resolution at which the image data was stored. Displaying the image data on such display systems typically results in a viewable image that is similar to the original image.

A typical method for reducing the cost of a display system is to limit the resolution of the digital-to-analog converters that are used to produce a video signal. Thus, pixel tone values are truncated when the resolution of the tone values exceed the resolution of the digital-to-analog converter used in a display system. However, truncated pixel tone values often result in perceptible, abrupt changes in tone in displayed images. Spatial dithering is often used to reduce the perceptibility of using truncated pixel tone values.

SUMMARY OF THE INVENTION

The present invention is directed towards a display system that dithers image data for storage in a frame buffer for display, where the image data is dithered according to a temporal stochastic dithering methodology. Dithering is used to reduce the size of the frame buffer and to reduce the complexity of the drive circuitry that is used to display an image. The bit depth of the frame buffer is reduced by spatially dithering image data before it is written into the frame buffer. Additionally, the displayed image is temporally dithered by using a different dither pattern for each successive frame. These different dither patterns are uncorrelated so as to minimize adverse temporal effects of the dither patterns within the displayed image.

A more complete appreciation of the present invention and its improvements can be obtained by reference to the accompanying drawings, which are briefly summarized below, to the following detailed description of illustrated embodiments of the invention, and to the appended claims.

DETAILED DESCRIPTION OF THE PREFERRED EMBODIMENT

Figure 1:
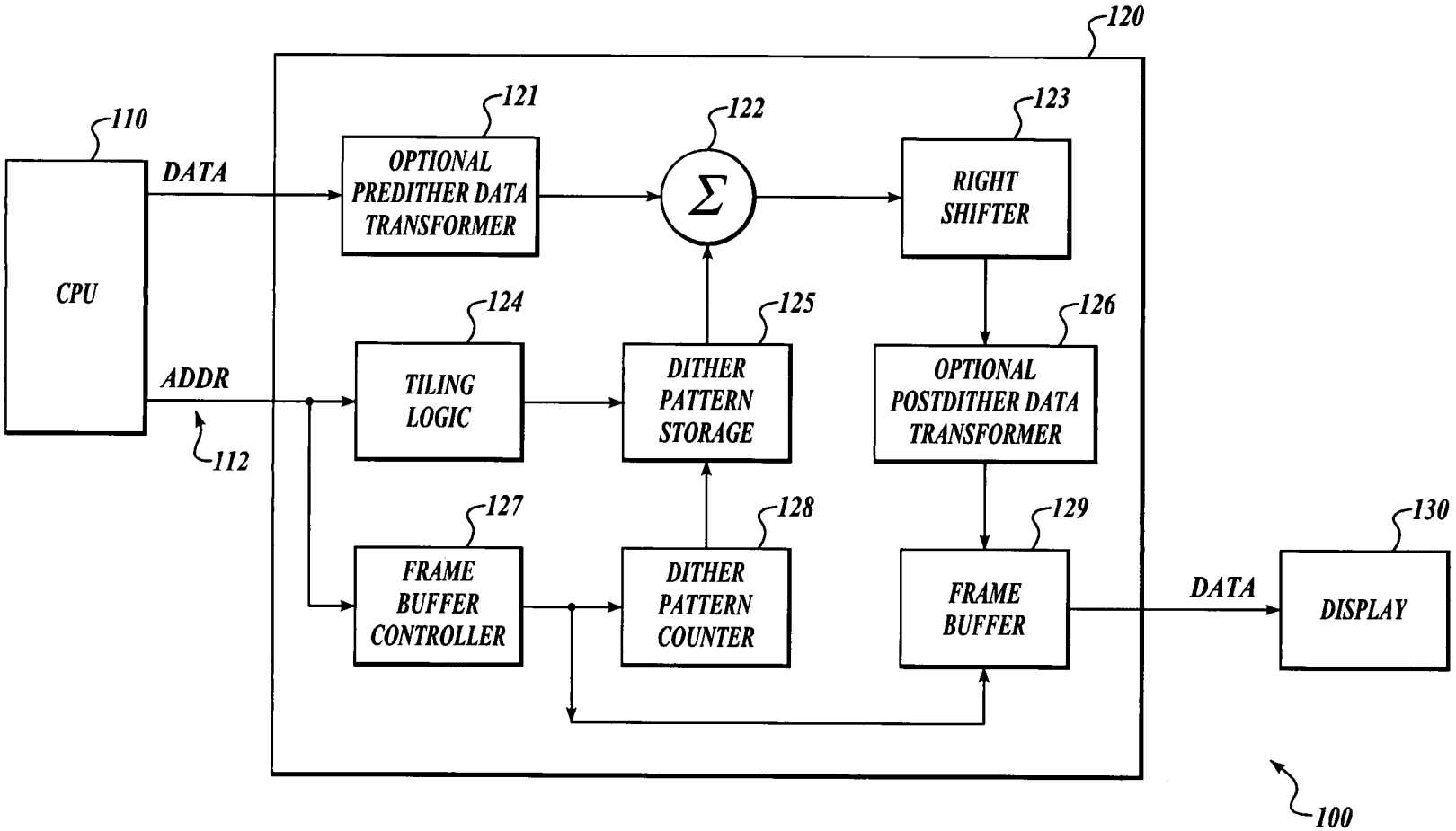
FIG. 1 is a schematic of an example temporal dither pattern generator system in accordance with the present invention.

In the following detailed description of exemplary embodiments of the invention, reference is made to the accompanied drawings, which form a part hereof, and which is shown by way of illustration, specific exemplary embodiments of which the invention may be practiced. These embodiments are described in sufficient detail to enable those skilled in the art to practice the invention, and it is to be understood that other embodiments may be utilized, and other changes may be made, without departing from the spirit or scope of the present invention. The following detailed description is, therefore, not to be taken in a limiting sense, and the scope of the present invention is defined only by the appended claims.

Throughout the specification and claims, the following terms take the meanings explicitly associated herein, unless the context clearly dictates otherwise. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected, or an indirect connection through one or more passive or active intermediary devices. The term "circuit" means either a single component or a multiplicity of components, either active and/or passive, that are coupled together to provide a desired function. The term "signal" means at least one current, voltage, or data signal. Referring to the drawings, like numbers indicate like parts throughout the views.

The present invention is directed towards a display system that provides temporal stochastic dithering to image data for storage in a frame buffer for display. Dithering is used to reduce the size of the frame buffer and the complexity of the drive circuitry that is used to display an image in accordance with the image data. The bit depth of the frame buffer is reduced by spatially dithering the image data before the image data is written into the frame buffer. Additionally, the displayed image is temporally dithered by using different dither patterns for successive frames. These dither patterns are uncorrelated so as to minimize detection of the dither patterns within the displayed image. Stochastic dithering is preferred because it facilitates the generation of a set of uncorrelated dither patterns.

FIG. 1 is a schematic of an example temporal dither pattern generator system in accordance with the present invention. As shown in the figure, temporal dither pattern generator system 100 includes CPU 110, temporal dither pattern generator 120, and display 130. Generator 120 includes an optional pre-dithering data transformer 121, saturating adder 122, right shifter 123, optional tiling logic 124, dither pattern storage 125, optional post-dithering data transformer 126, frame buffer controller 127, dither pattern counter 128, and frame buffer 129.

CPU 110 is coupled to pre-dithering data transformer 121, tiling logic 124, and frame buffer controller 127. Pre-dithering data transformer 121 is coupled to saturating adder 122. Saturating adder 122 is coupled to right shifter 123. Right shifter 123 is coupled to post-dithering data transformer 126. Post-dithering data transformer 126 is coupled to frame buffer 129. Tiling logic 124 is coupled to dither pattern storage 125. Dither pattern storage 125 is coupled to saturating adder 122. Frame buffer controller 127 is coupled to dither pattern selector 128 and frame buffer 129. Dither pattern selector 128 is coupled to dither pattern storage 125.

Frame buffer 129 is coupled to display 130. If optional pre-dithering data transformer 121 is not present, CPU 110 is coupled to saturating adder 122. If optional post-dithering data transformer 126 is not present, right shifter 123 is coupled to frame buffer 129.

CPU 110 is any processing unit that is suitable for providing data for still or moving images. In an example embodiment, CPU 110 provides image data and corresponding addresses for the image data to generator 120. Generator 120 receives the image data from CPU 110 in pre-dithering data transformer 121 and data image addresses for the data in optional tiling logic 124 and frame buffer controller 127. If optional tiling logic 124 is not present, data image addresses are connected to the dither pattern storage 125. Generator 120 dithers the image data before storing the dither image data in frame buffer 129. Generator 120 provides the stored image data to display 130.

Pre-dithering data transformer 121 applies transforms, such as gamma processing, to the image data before it is dithered. Gamma processing may be used to adjust quantization levels associated with the image data. Quantization levels may be adjusted, for example, so that the viewable image represented by the image data can be displayed according to the sensitivity of the human vision system.

For gamma values near or below below 1.0, dithering artifacts are more visible in darker regions of the image. For larger gamma values, dithering artifacts become more visible in lighter regions of the image. The input image data may be transformed into an optimal gamma representation that minimizes the visibility of dithering in all regions of the image.

Adder 122 receives image data from pre-dithering data transformer 121 typically one pixel at a time. Adder 122 receives dither values from dither pattern storage 125. (The generation and selection of the dither values are described below with reference to tiling logic 124 and dither pattern counter 128.) Adder 122 adds a received dither value to a tone value associated with a pixel from the image data received from pre-dithering data transformer 121. In one example, dither values are retrieved having a bit depth that is equal to the number of bits to be truncated. The retrieved dither values are added to the lower order bits of the (pretruncated) tone value associated with a received pixel such that a dithered tone value is produced.

Right shifter 123 receives the dithered tone value for truncation. Right shifter 123 shifts the bits in the dithered tone value to the right. The dithered tone value is repeatedly right shifted until the number of bits remaining is equal to the number of bits that are required by display 130.

The truncated dithered tone value is optionally processed by post-dithering data transformer 126. Post-dithering data transformer 126 applies transforms, such as gamma processing, after image data has been dithered. Post-dithering data transformer 126 transforms image data in an inverse fashion to pre-dithering data transformer 121.

Frame buffer 129 is used to store image data for display 130. Display 130 may receive a stored frame of the image data synchronously or asynchronously with respect to the loading of the image data to frame buffer 129. (For example, frame buffer 129 may be dual-ported such that it can read and write simultaneously.) The input frame rate corresponds to the rate at which frame buffer 129 receives a frame of the image data. Frame buffer 129 may receive a stored frame, an update to the stored frame, or no update for each stored frame that is displayed by display 130.

CPU 110 typically supplies an address for a pixel to generator 120, where each address is associated with a corresponding pixel of the image data. Tiling logic 124 receives the address and derives an index for a selected dither pattern. (The dither pattern to be used is selected by dither pattern selector 128, as described below.) In one example, the dither pattern is tiled in two dimensions across the image. Tiling logic 124 uses a selected number of least significant bits from a row within pixel address 112 to select a row within the currently selected dither pattern. Tiling logic 124 uses a selected number of least significant bits from a column within pixel address 112 to select a column within the currently selected dither pattern. If the optional tiling logic 124 is not present, the entire row and column pixel addresses are used to select a row and a column within the currently selected dither pattern. The row and column addresses are arranged to select an address for a dither value from dither pattern storage 125. The selected dither value is added to a pixel from the input image data having the received address and truncated as described above.

Dither pattern storage 125 contains uncorrelated dither patterns. The use of such uncorrelated dither patterns reduces the visibility of temporal artifacts that are introduced by dithering. (The temporal artifacts become more visible at lower output frame rates.) Additionally, the bit-depth of the frame store can be reduced by dithering input pixel data before writing the image data into the frame store. Stochastic dither patterns containing relatively little low frequency content (i.e. "blue noise") are preferred because such patterns reduce the visibility of spatial artifacts that are produced by the dithering, while also facilitating the generation of sets of uncorrelated dither patterns.

An algorithm suitable for generating stochastic dither patterns is described in U.S. Pat. No. 5,111,310, which is incorporated herein by reference.

Frame buffer controller 127 initializes dither pattern selector 128 and provides an output frame rate signal. Dither pattern selector 128 selects a dither pattern from which dither values are received for dithering. In one embodiment, dither pattern selector 128 receives the output frame rate signal and selects a different dither pattern for each output frame in response thereto. A different dither pattern may be selected after each frame and/or after a plurality of frames. In other modes of operation, dither pattern selector 128 can select a different dither pattern at other times, including in the middle of the process of dithering a frame. Alternatively, or in conjunction with the above-mentioned variations, dither pattern selector 128 can change the selected dither pattern for portions of a frame, such as when only part of a frame is updated with new data.

After several output frames, the selection order, if any, of dither patterns may be repeated. Frame buffer 129 outputs a stored frame with image data in response to the output frame rate signal.

Figure 2:
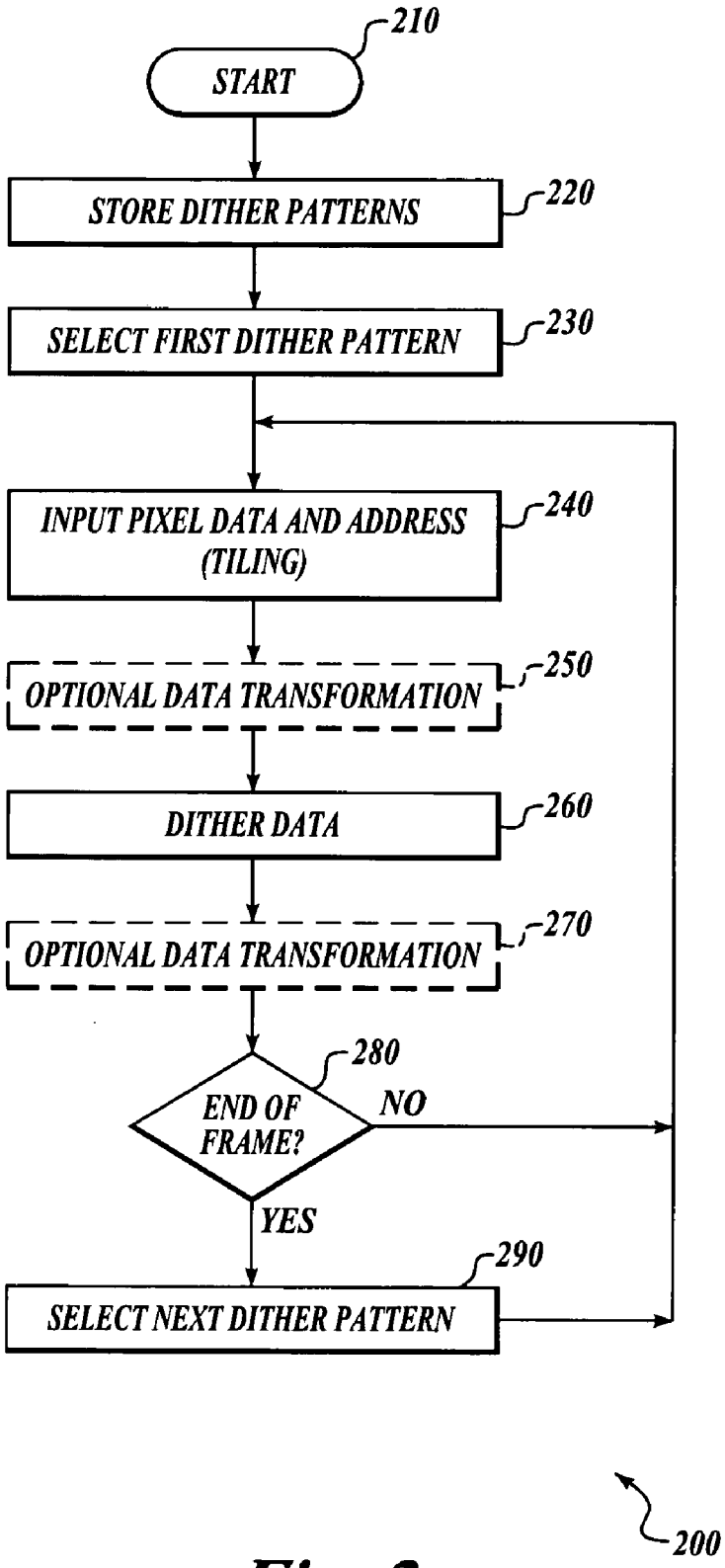
FIG. 2 the flow graph diagram of a method for temporal stochastic dithering of image data contained within a frame buffer in accordance with the present invention.

FIG. 2 is a flow graph diagram of a method for temporal stochastic dithering in accordance with the present invention. In block 210, method 200 is initiated.

In block 220, dither patterns are stored as in, for example, dither pattern storage 125. Typically blue noise dither patterns are provided because blue noise dither patterns are less likely to introduce either spatial or temporal artifacts that are undesirably visible to the human vision system. Optionally, the dither patterns can be smaller than the displayed image. Using smaller dither patterns requires less memory for dither pattern storage, allowing many different dither patterns to be easily stored. The smaller dither patterns can be tiled across an image to provide dithering for the entire image. Visible seams between the tiled patterns can be avoided by using dither patterns that do not produce visible seams when tiled.

For example, blue noise dither patterns as described in U.S. Pat. No. 5,111,130 have this characteristic.

In block 230, a first dither pattern is selected.

In block 240, a dither value is selected for a received pixel of data. The received pixel of data has an associated address. The associated address represents the location of the pixel data in the image. A value within the dither pattern is selected in response to the address of the received pixel (as discussed above with reference to tiling logic 124 and discussed below with reference to FIG. 3).

In block 250, the input pixel data is optionally transformed as discussed above with reference to pre-dithering data transformer 121.

In block 260, the input pixel data is dithered. A dithered pixel is determined by adding the dither value to the pixel data. The resulting sum is limited to the range of the input pixel values by using a saturating adder. The dithered pixel data is truncated by a predetermined number of bits to provide truncated pixel data. The predetermined number of bits is associated with the requirements of the display.

In block 270, the truncated pixel data is optionally transformed as discussed above with reference to post-dithering data transformer 126.

In block 280, method 200 determines whether the end of the frame of the input image has been encountered. Method 200 proceeds to block 240 when additional pixel data in the frame are to be processed. Method 200 proceeds to block 290 when the end of the frame of the input image has been encountered.

In block 290, the next dither pattern is selected, whereupon method 200 proceeds to block 240.

Blocks 240-290 form a processing loop that may be terminated upon an event such as halts, reset, an interrupt, and the like, which may be generated by a supervisory process and/or system hardware.

Figure 3:
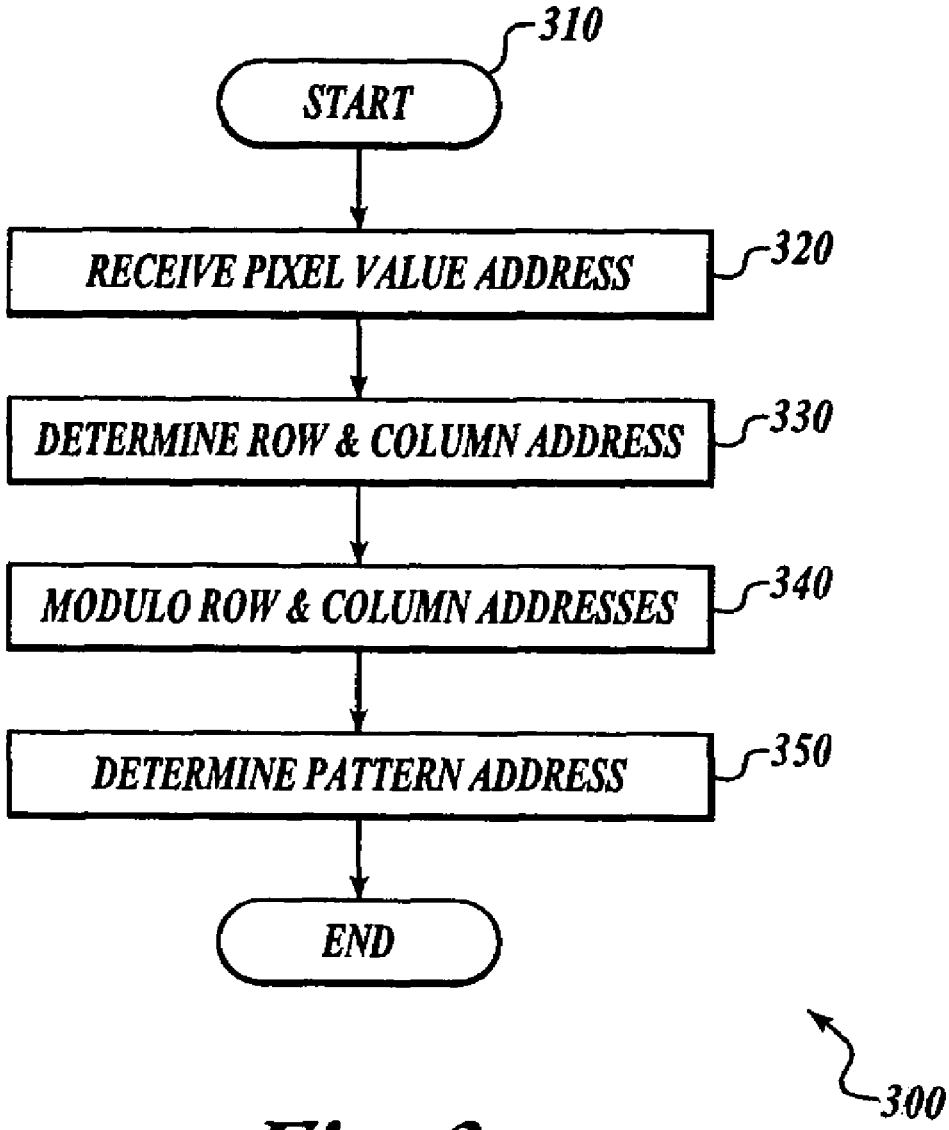
FIG. 3 is a flow diagram of an exemplary method for tiling dither patterns in accordance with the present invention.

FIG. 3 is a flow diagram of an exemplary method for tiling dither patterns in accordance with the present invention. In block 310, method 300 is initiated.

In block 320, an address is received for a pixel that is to be dithered.

In block 330, the received address is decomposed into row and column addresses that are associated with the pixel that is to be dithered.

In block 340, the column and row addresses for the dither pattern are calculated. In one embodiment, a modulus function is used to determine the column and row addresses that are used to select a particular dither value from a selected dither pattern. The modulus function uses the column (or row) address as the dividend and the column (or row) width of the dither pattern as the modulus to determine a remainder. The remainder is used to select the column (or row) address of the dither value from the dither pattern. If either of the column or row dimensions of the dither pattern are equal to two raised to N, where N is a positive integer, then the corresponding remainder is the N least significant bits of that address.

In block 350, the column and row remainders are used in conjunction with the address of the selected dither pattern to determine the address of a dither value.

Method 300 returns to a parent routine when the dither value for a selected pixel has been determined.

Other embodiments of the invention are possible without departing from the spirit and scope of the invention.

In another example bit truncation may occur after data is retrieved from frame buffer 129.

In similar fashion, image data pixels may be supplied in a predetermined order such that providing addresses with each pixel is not necessary for determining the location of the pixel for which the data image is supplied.

The dither pattern counter can be selected by, for example, CPU 110 for each displayed frame, rather than being automatically selected by the dither pattern counter. CPU 110 could also load different dither patterns into the dither pattern storage 125 for different frames or for different groups of frames.

In one example, the system can display polychromatic data. For example, one dithering system can be provided for each individual color to the displayed. In an additive color system, a red system, a green system, and a blue system can be combined to produce an output signal that is suitable for driving a polychromatic display.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A circuit for stochastic dithering, comprising:

a dither pattern store that is configured to provide stochastic dither patterns;

an image data source that is configured to provide pixel data that is associated with a temporal sequence of image frames;

a dither pattern selector that is configured to select different stochastic dither patterns for image frames within the temporal sequence of image frames; and a saturating adder that is configured to add a selected dither value from the selected dither pattern to a selected pixel value from an associated section of image data, whereby a dithered pixel is produced with a value that is limited to the range of values that are allowed for the image data source pixels.

2. The circuit of claim 1, wherein the circuit further comprises a frame buffer that is configured to receive a sequence of dithered pixels.

3. The circuit of claim 2, wherein the saturating adder is further configured to truncate each of the dithered pixels before storing in the frame buffer.

4. The circuit of claim 1, wherein the circuit further comprises a tiling logic unit that is configured to tile a selected dither pattern from the dither pattern store, wherein the selected dither pattern is tiled across each frame within the temporal sequence of image frames, whereby the selected dither pattern is associated with a plurality of sections of image data within each frame within the temporal sequence of image frames, and wherein the tiling logic unit is configured to select a dither value in response to an address that is associated with the selected pixel value.

5. The circuit of claim 4, wherein the dither pattern column address of the selected dither value is generated in response to a column address that is associated with the selected pixel value, and wherein the dither pattern row address of the selected dither value is generated in response to a row address that is associated with the select pixel value.

6. The circuit of claim 5 wherein the dither pattern column address comprises the least significant bits of the column address that is associated with the selected pixel value, and wherein the dither pattern row address comprises the least significant bits of the row address that is associated with the selected pixel value.

7. The circuit of claim 1, wherein the dither pattern selector is configured to select different dither patterns in response to a frame rate signal.

8. The circuit of claim 1, wherein the dither patterns is configured to select dither patterns in response to an updating of image data with new data.

9. A circuit for stochastic dithering, comprising:

means for providing stochastic dither patterns;

means for providing pixel data that is associated with a temporal sequence of image frames;

means for selecting a different stochastic dither pattern for each image frame within the temporal sequence of image frames; and means for adding a selected dither value from the selected dither pattern to a selected pixel value from an associated section of image data, whereby a dithered pixel is produced with a value that is limited to the range of values that are allowed for the image data source pixels.

10. The circuit of claim 9, further comprising means for storing a sequence of dithered pixels in a frame buffer.

11. The circuit of claim 10, wherein the means is configured to truncate each of the dithered pixels in the sequence of dithered pixels before storing in the frame buffer.

12. The circuit of claim 9, further comprising means for tiling a selected dither pattern from the provided dither patterns, wherein the selected dither pattern is tiled across each frame within the temporal sequence of image frames, and whereby the selected dither pattern is associated with a plurality of sections of image data within each frame within the temporal sequence of image frames.

13. The circuit of claim 12, further comprising means for selecting a dither value in response to an address that is associated with the selected pixel value.

14. The circuit of claim 13, further comprising means for generating a dither pattern column address of the selected dither value in response to a column address that is associated with the selected pixel value, and means for generating a dither pattern row address of the selected dither value in response to a row address that is associated with the select pixel value.

15. The circuit of claim 14, wherein the generated dither pattern column address comprises the least significant bits of the column address that is associated with the selected pixel value, and wherein the generated dither pattern row address comprises the least significant bits of the row address that is associated with the selected pixel value.

16. A method for stochastic dithering, comprising:

providing stochastic dither patterns;

providing pixel data that is associated with a temporal sequence of image frames;

selecting different stochastic dither patterns for image frames within the temporal sequence of image frames; and adding a selected dither value from the selected dither pattern to a selected pixel value from an associated section of image data, whereby a dithered pixel is produced with a value that is limited to the range of values that are allowed for the image data source pixels.

17. The method of claim 16, further comprising storing a sequence of dithered pixels in a frame buffer.

18. The method of claim 17, wherein each of the dithered pixels in the sequence of dithered pixels is truncated before storing in the frame buffer.

19. The method of claim 16, further comprising tiling a selected dither pattern from the provided dither patterns, wherein the selected dither pattern is tiled across each frame within the temporal sequence of image frames, whereby the selected dither pattern is associated with a plurality of sections of image data within each frame within the temporal sequence of image frames.

20. The method of claim 19, further comprising selecting a dither value in response to an address that is associated with the selected pixel value.

21. The method of claim 20, further comprising generating a dither pattern column address of the selected dither value in response to a column address that is associated with the selected pixel value, and generating a dither pattern row address of the selected dither value in response to a row address that is associated with the select pixel value.

22. The method of claim 21, wherein the generated dither pattern column address comprises the least significant bits of the column address that is associated with the selected pixel value, and wherein the generated dither pattern row address comprises the least significant bits of the row address that is associated with the selected pixel value.

23. The method of claim 16, wherein the selecting dither patterns includes selecting dither patterns in response to a frame rate signal.

24. The method of claim 16, wherein the selecting dither patterns includes selecting dither patterns when a portion of a frame is updated with new data.

* * * * *